United States Patent [19]

Miyamoto

[11] 4,078,493

[45] Mar. 14, 1978

[54] DESENSITIZING USING DRY REVERSE LITHOGRAPHIC PLATE

[75] Inventor: Akio Miyamoto, Fujimiya, Japan

[73] Assignee: Fuji Photo Film Co., Ltd., Minami-ashigara, Japan

[21] Appl. No.: 635,543

[22] Filed: Nov. 26, 1975

[30] Foreign Application Priority Data

Nov. 26, 1974 Japan ..... 49-136905

[51] Int. Cl.[2] ..... B41M 1/08; B41M 3/00

[52] U.S. Cl. ..... 101/450; 101/465; 106/2; 106/14.5; 106/19

[58] Field of Search ..... 101/450, 465

[56] References Cited

U.S. PATENT DOCUMENTS

| | | | |
|---|---|---|---|
| 2,777,780 | 1/1957 | Cormack et al. | 427/150 X |
| 3,368,483 | 2/1968 | Storms | 101/450 |
| 3,455,240 | 7/1969 | Martel et al. | 101/450 |
| 3,486,922 | 12/1969 | Cassiers et al. | 117/37 |
| 3,513,000 | 5/1970 | Vrancken et al. | 101/450 X |
| 3,608,483 | 9/1971 | Kaminstein | 101/148 |
| 3,677,178 | 7/1972 | Gipe | 101/450 |
| 3,772,016 | 11/1973 | Anderson et al. | 101/450 |
| 3,834,909 | 9/1974 | Usui et al. | 96/1 LY |

FOREIGN PATENT DOCUMENTS

| | | | |
|---|---|---|---|
| 903,724 | 8/1962 | United Kingdom | 101/450 |

OTHER PUBLICATIONS

Pp. 182 and 183 of Photolithography by Tory on Contact Angles.

*Primary Examiner*—Clyde I. Coughenour
*Attorney, Agent, or Firm*—Sughrue, Rothwell, Mion, Zinn and Macpeak

[57] ABSTRACT

A process for producing a locally desensitized color developer sheet which comprises using a desensitizer composition having a contact angle of not less than 15° with hydrophobic non-image areas of a lithographic pringing plate and having a wetting action with the hydrophilic image areas of said plate. Using a hydrophilic image lithographic plate to selectively desensitize a color developer sheet using the desensitizer composition.

3 Claims, No Drawings

DESENSITIZING USING DRY REVERSE LITHOGRAPHIC PLATE

BACKGROUND OF THE INVENTION

1. Field of the Invention

The present invention relates to a desensitization printing process, more particularly, to a desensitization printing process which comprises using in combination a printing plate consisting of hydrophilic image areas and oleophilic non-image areas and a desensitizer specified by its specific contact angle with the non-image areas.

2. Description of the Prior Art

It has long been known to obtain color images through a contact reaction between an electron donating or proton accepting colorless organic compound (hereinafter referred to as a color former) and an electron accepting or proton donating solid acid (hereinafter referred to as a color developer). As a specific use of this phenomenon, there can be illustrated pressure-sensitive copying papers (see, e.g., U.S. Pat. Nos. 2,505,470, 2,505,489, 2,550,471, 2,548,366, 2,712,507, 2,730,456, 2,730,457, 3,418,250, 3,672,935, etc.), heat-sensitive recording papers (see, e.g., Japanese Patent Publications 4,160/68, 7,600/68 and 14,039/70 and U.S. Pat. No. 2,939,009), and the like. Furthermore, there is known a printing process for obtaining colored images by supplying a color former-containing ink to a color developer-coated sheet (see German Pat. No. 1,939,962).

Since these recording sheets comprise a support having coated on the whole surface thereof a color developer layer, it is common to desensitize areas of the color developer layer where recording is not desired by coating on the areas a desensitizer-containing printing ink via typographic printing or intaglio printing. As the desensitizer, organic amines or the quaternary salts thereof (see U.S. Pat. No. 2,777,780), tertiary amines wherein monoalkylamine, aralkylamine or ethanolamine is chemically combined with ethylene oxide (see Japanese Patent Publication 35,697/71), spiroacetal diamines and a reaction product between spiroacetal diamine and an oxirane group-containing compound (see German Patent Application OLS 2,343,800), N-(aminoalkyl)-lactams or derivatives thereof (see German Patent Application OLS 2,359,079), amidines as shown in German Patent Application OLS 2,361,856, amines as shown in Japanese Patent Application 132,331/73, silane compounds as shown in Japanese Patent Application 32,337/74, and the like have been used.

However, all desensitizers described above are water-soluble and hydrophilic.

Generally, printing processes can be classified as a: (1) typographic printing process, (2) intaglio printing process, (3) lithographic printing process, (4) stencil printing process, etc.

Each of these printing processes naturally requires a printing ink suitable therefor.

Typographic printing processes and intaglio printing processes have heretofore been employed as desensitization printing processes. However, the very popular lithographic printing process has not been so employed, since it has been technically impossible to prepare a desensitizing ink having suitable properties for lithographic printing.

Lithographic printing involves forming images using a printing plate consisting of hydrophilic non-image areas and oleophilic image areas, first adhering water (hereinafter referred to as damping water) to the hydrophilic areas of the printing plate, then adhering an oily printing ink to the image-forming oleophilic areas and transferring the ink directly or indirectly onto the materials to be printed.

In this case, damping water adhering to the hydrophilic areas repels the oily printing ink, and hence the printing ink adheres only to the image-forming oleophilic areas, and is then printed to form images. Therefore, when a printing ink contacting an hydrophilic desensitizer which is not damping water-repellent is used, such a printing ink becomes mixed with the damping water adhering to non-image areas of the printing plate, and images cannot be formed by lithographic printing.

Since lithographic printing has the advantages that plate-making can be effected rapidly and inexpensively and that printed images are of good quality and uniform, it has currently become the most typical printing process, and lithographic presses have come into wide use.

However, it has heretofore been impossible to conduct desensitization printing by lithographic printing. Thus, the art has strongly desired a desensitization printing process which can be effected using a lithographic press.

The present invention provides the art with such a process.

SUMMARY OF THE INVENTION

One object of the present invention is to provide a desensitization printing which can be practiced by lithographic printing.

Another object of the present invention is to provide a desensitization printing process which exhibits an extremely high desensitizing effect on all color formers.

A further object of the present invention is to provide a desensitization printing process which exhibits an extremely high desensitizing effect on all color developers.

Still a further object of the present invention is to provide an image-forming process using a desensitizer which is in a special relationship with non-image areas.

Yet a further object of the present invention is to provide a lithographic printing process which comprises coating on hydrophilic areas a desensitizer.

As a result of intensive research, the inventors discovered that the above-described objects of the present invention can fully be attained by using a lithographic plate consisting of hydrophilic image areas and oleophilic non-image areas, which is the reverse of conventional lithographic plates, and by using a desensitizer showing a contact angle of not less than 15° in non-image areas.

DETAILED DESCRIPTION OF PREFERRED EMBODIMENTS

The process for preparing a plate material or lithographic printing plate consisting of oleophilic areas and hydrophilic areas as is herein referred to is conventional and is described in detail in, for example, Hasegawa; Shashin Seihan Gijutsu (Photomechanical Process Techniques) (Insatsu Shuppan Kenkyujo), pp. 430 – 468, and Kikuchi et al; Shashin Kogaku IV, pp. 356 – 364 (Kyoritsu Shuppan Co., Ltd.), and in U.S. Pat. Nos. 3,050,502 and 3,046,120.

As plate materials, those which are known as materials for lithographic printing, e.g., photo cross-linking type, photo-polymerizable type and photo-decomposable type plate materials can be utilized. These are described in detail in, for example, J. Kosar; Light Sensitive Systems John Wiley (1965), Kankosei Jushi (Light-sensitive Resins) Nikkan Kogyo Shinbunsha (1973), U.S. Pat. Nos. 3,775,112, 3,776,737 and 3,799,915, and the like.

For instance, examples of photocross-linking type plate materials include cinnamic acid derivatives and phenylene diacrylic acid derivatives, examples of photo-polymerizable type plate materials include polyacrylic acid derivatives and polymethacrylic acid derivatives, and examples of photo-decomposable type plates material include O-quinone diazide derivatives, azide derivatives and diazo derivatives.

The desensitizer usable in the present invention is preferably organic and must be strongly "repelled" at oleophilic areas of the lithographic plate, showing a contact angle of not less than 15°, preferably not less than 25°. While not as important as the minimum contact angle, it is generally most preferred that the maximum contact angle of the desensitizer with respect to the lithographic plate be about 150°. Some examples thereof are shown below which, should not, however, be construed as limitative. Generally, compounds having at least one hydroxy, amino (primary, secondary, tertiary, quarternary), ester, ether or amido group show a desensitizing action. Of these, hydroxy or amino group-containing compound, show a strong desensitizing action and are preferred.

Specific examples thereof include:

Polyethylene glycol (having a mean molecular weight of preferably about 100 to about 2000).

Polyalkylene polyamines represented by the following general formula;

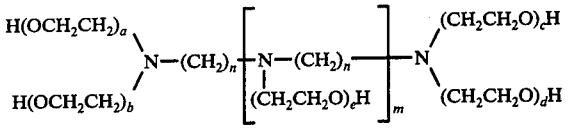

wherein $n$ represents an integer of 2 – 5, $m$ represents an integer of 0 – 6, $a$, $b$, $c$, $d$ and $e$ each represents an integer other than 0 and $a + b + c + d + e$ are about 5 – 200.

Amine derivatives represented by the following general formula;

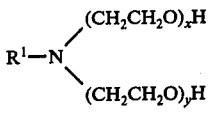

wherein $R^1$ represents a $C_2$–$C_{10}$ alkyl group, an aryl group, preferably with up to 18 carbon atoms, an arakyl group, preferably of from 7 to 18 carbon atoms, or $(CH_2CH_2O)_zH$, $x + y$ being about 3 – 100 and $x + y + z$ are about 5 - 100. The aryl groups include monoaryl and polyaryl groups and such groups which are substituted with, e.g., alkyl, alkoxy, halogen, amino, hydroxy, di(ω-hydroxyalkyl)amino and like groups. Preferred materials comprise from 6 to about 150 carbon atoms.

Spiroacetal diamines represented by the following general formula as disclosed in U.S. Application Ser. No. 393,089;

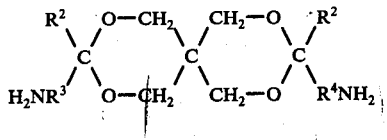

wherein $R^2$ represents a hydrogen atom or an alkyl group, and $R^3$ and $R^4$ each represents a $C_1$ – $C_6$ straight or branched chain alkylene group.

Reaction products between the above-described spiroacetal diamine and a compound containing in its molecule one or more oxirane groups, preferably of from 2 to 25 carbon atoms, for example, butyl glycidyl ether, phenyl acetyl ether, phenyl acetyl ether, glycerin triglycidyl ether and the like.

Diazabicycloalkenes represented by the following general formula;

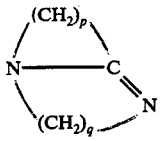

wherein $q$ represents 2 – 6, and $p$ represents 2 – 11 and compounds between the above-described diazabicycloalkene and water or an acid, including both mineral acids and organic acids, for example, hydrochloric acid, acetic acid, oleic acid, and the like. The desensitizer described above is coated in an amount of about 0.5 $g/m^2$ to about 8.0 $g/m^2$, preferably 1.5 $g/m^2$ to 5.0 $g/m^2$, on a color developer sheet. The present invention will be more specifically described below.

Firstly, a desensitizing ink containing the above-described desensitizer is applied to a lithographic printing plate consisting of oleophilic non-image areas and hydrophilic image areas. The desensitizing ink is "repelled" at the oleophilic non-image areas, and therefore does not adhere to these areas, and only adheres to the hydrophilic image areas. Printing of the desensitizer is then effected by transferring the image-wise adhering desensitizing ink to a color developer sheet directly or after transferring the ink to a blanket. Damping water heretofore necessary for lithographic printing is not necessary in the present invention. Therefore, the troublesome use of damping water involving the difficult problems of determining the settling, the amount thereof to be added, and the time of the addition can be avoided.

The desensitizing ink may be fed to a printing plate using the damping water-feeding device of a lithographic press or using a conventional ordinary lithographic ink-feeding device.

As the desensitizing ink in the present invention, the aforesaid desensitizer may be used alone or upon dilution with water or with an organic solvent. As the organic solvent, there can be used those which have a dielectric constant (at 20° C) of not less than about 5.0, preferably not less than 10, and a surface tension (at 20° C) of not less than about 15 dyne/cm, preferably not less than 20 dyne/cm. For example; alcohols such as methanol, ethanol, propanol, etc.; ketones such as acetone, methyl ethyl ketone, methyl isobutyl ketone, etc.; esters such as ethyl acetate, butyl acetate, etc.; polyhydric alcohols such as glycerin, ethylene glycol, polyethylene glycol, etc.; and the like.

Water or the organic solvent(s) is used in the ink composition in a proportion of from 0 to about 80% (by weight), preferably from 0 to 60% (by weight).

There may be added a white pigment and or an extender pigment to impart whiteness, opacity and printability to the desensitizing ink, and a resin to adhere these pigments to the material to be printed. The amount added is 0 - 30 wt %, preferably 0 - 10 wt %, based on the total weight of the ink formed, including pigments and/or resins.

As the white pigment and extender pigment, those described in E.A. Apps; Printing Ink Technology LEONARD HILL (London), 1961, pp. 116 - 125 can be used. In particular, titanium dioxide, barium sulfate and calcium carbonate are preferred.

As the resin, those described in Printing Ink Technology, pp. 40 - 84 and p. 396 can be used. In particular, ketone-aldehyde resins and maleic acid resins are preferably employed. The resin component can be used in the ink in a proportion of 0 - 20%, preferably 0 - 10%, both based on the total weight of the ink formed. Also, if desired, an anti-offset agent such as starch can be added to the desensitizing ink of the present invention in a proportion of 1 - 10 wt %.

The color developer sheet to which the desensitization printing process of the present invention can be applied fundamentally comprises a support having provided thereon a color developer layer.

The color developer is one which possesses the previously defined properties and includes clays, phenol resins, metal salts of aromatic carboxylic acids, and the like. The clays include acid clays, activated clays, attapulgite, kaolin, etc. Of these, clays having a three-layered structure, i.e., acid clays, activated clays and the like have a high color-developing ability, and hence they are very effective in the present invention. Although other clays also show some effect, their color-developing ability is less than clays having the three-layered structure, i.e., acid clays, activated clays, and the like, and hence they are not as preferred. Various useful color developers are also exemplified in U.S. Pat. Nos. 3,649,357, 3,672,935 and 3,737,410.

The phenol resins used include all proton-releasing phenol resins conventional in the art, i.e., they are phenolaldehyde polymers (novolak type) and phenol-acetylene polymers, usually at an aldehyde/phenolic or acetylene/phenolic compound ratio of at most 1, usually a mixture thereof having condensation degree of 2 - 6.

Examples thereof include p-phenylphenol-formaldehyde polymers, p-flurophenol-formaldehyde polymers, p-chlorophenol-formaldehyde polymers, p-bromophenol-formaldehyde polymers, p-iodophenol-formaldehyde polymers, p-nitrophenol-formaldehyde polymers, p-carboxyphenol-formaldehyde polymers, o-carboxyphenol-formaldehyde polymers, p-carboalkoxyphenol-formaldehyde polymers, p-aroylphenol-formaldehyde polymers, p-lower alkoxyphenol-formaldehyde polymers (where preferred alkoxy, aroyl and lower alkoxy groups have from 1 to about 8 carbon atoms, most preferably from 2 to 10 carbon atoms), copolymers between p-alkyl($C_1$ - $C_{12}$) phenols (e.g., p-methylphenol, p-ethylphenol, p-n-propylphenol, p-isopropylphenol, p-n-amylphenol, p-isoamylphenol, p-cyclohexylphenol, p-1,1-dimethyl-n-propylphenol, p-n-hexylphenol, p-isohexylphenol, p-1,1-dimethyl-n-butylphenol, p-1,2-dimethyl-n-butylphenol, p-n-heptylphenol, p-isoheptylphenol, p-5,5-dimethyl-n-amylphenol, p-1,1-dimethyl-n-amylphenol, p-n-octylphenol, 1,1,3,3-tetramethylbutylphenol, p-isooctylphenol, p-n-nonylphenol, p-isononylphenol, p-1,1,3,3-tetramethylamylphenol, p-n-decylphenol, p-isodecylphenol, p-n-undecylphenol, p-isoundecylphenol, p-n-dodecylphenol, etc.), isomers of such p-alkylphenols (where preferred alkyl phenols or isomers thereof comprise an alkyl moiety of from 1 to about 18 carbon atoms, most preferably 2 to 10 carbon atoms), or a mixture of two or more of such alkylphenols and isomers thereof, and formaldehyde. If an m-substituent is introduced into the above-described p-substituted phenols, they behave in the same manner. Thus, the introduction of m-substituent has no impact.

The aromatic carboxylic acids used to form metal salts of aromatic carboxylic acid include those represented by general formula I;

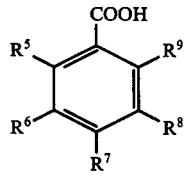

(I)

wherein $R^5$, $R^6$, $R^7$, $R^8$ and $R^9$ each represents a hydrogen atom, a halogen atom, a nitro group, an aldehyde group, an alkyl group, a cycloalkyl group, an aryl group, an alkaryl group, an aralkyl group or an alkoxy group, and $R^5$, $R^6$, $R^7$, $R^8$ and $R^9$ may be connected with an adjacent member from this group to form a ring, most preferably to form a 5 or 6 membered ring, though this is not limitative as examples of such rings include benzene, naphthalene and cyclohexene. Preferred alkyl, cycloalkyl, aryl, alkaryl, aralkyl and alkoxy groups have from 1 to about 18 carbon atoms, most preferably 2 to 10 carbon atoms. The present invention is not limited to such preferred groups, however.

Of the compounds represented by general formula (I), compounds represented by the general formula (II) are particularly preferred in the present invention;

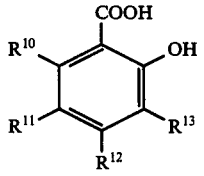

(II)

wherein $R^{10}$, $R^{11}$, $R^{12}$ and $R^{13}$ are the same as defined above for $R^5$ to $R^8$, respectively.

Alkali metal salts of the aromatic carboxylic salts include sodium salts, potassium salts lithium salts, cesium salts, and the like. These are most conveniently used as a starting material and are reacted with a water-soluble metal salt to provide the metal salt of an aromatic carboxylic acid.

As specific examples of the aromatic carboxylic acid, there can be illustrated benzoic acid, (o-, m-, p-) chlorobenzoic acid, (o-, m-, p-) toluic acid, 4-methyl-3-nitrobenzoic acid, 2-chloro-4-nitrobenzoic acid, 2,3-dichlorobenzoic acid, 2,4-dichlorobenzoic acid, p-isopropylbenzoic acid, 2,5-dinitrobenzoic acid, p-tert-butylbenzoic acid, N-phenylanthranilic acid, 4-methyl-3-nitrobenzoic acid, salicylic acid, (m-,p-) hydroxybenzoic acid, 3,5-dinitrosalicylic acid, 5-tert-butylsalicylic acid, 3-phenylsalicylic acid, 3-methyl-5-tert-butylsalicylic acid, 3,5-di-tert-butylsalicylic acid, 3,5-di-tert-amylsalicylic acid, 3-cyclohexylsalicylic acid, 5-cyclohexylsalicylic acid, 3-methyl-5-isoamylsalicylic acid, 5-isoamylsalicylic acid, 3,5-di-sec-butylsalicylic acid, 5-nonylsalicylic acid, 2-hydroxy-3-methylbenzoic acid, 2-hydroxy-5-tert-butylbenzoic acid, 2,4-cresotinic acid, 5,5-methylenedisalicylic acid, (o-, m-, p-) acetaminobenzoic acid, 2,4-dihydroxybenzoic acid, 2,5-dihydroxybenzoic acid, anacardic acid, 1-naphthoic acid, 2-naphthoic acid, 1-hydroxy-2-naphthoic acid, 2-hydroxy-3-naphthaoic acid, 2-hydroxy-1-naphthoic acid, thiosalicylic acid, 2-carboxybenzaldehyde, and the like.

The water-soluble metal salts capable of reacting with an alkali metal salt of such an aromatic carboxylic acid to produce a metal salt of the aromatic carboxylic acid as a color developer include hydrochlorides, sulfates, nitrates, etc., of the metals of group IB in the periodic table (e.g., copper, lead, etc.), metals of group IIA (e.g., magnesium, calcium, etc.), metals of group IIB (e.g., zinc, cadmium, mercury, etc.), metals of group IIA (e.g., aluminum, gallium, etc.), metals of group IVA (e.g., tin, lead, etc.), metals of group VIB (e.g., chromium, molybdenum, etc.), metals of group VIIB (e.g., manganese, etc.), metals of group VIII (e.g., cobalt, nickel, etc.), and the like. Of these metal salts, the hydrochlorides, sulfates and nitrates of zinc, tin, aluminum, magnesium and calcium are particularly effective.

A color developer sheet can be obtained by coating on a conventional support such as paper, a synthetic paper, a plastic film or the like a coating solution prepared by dispersing or dissolving a color developer and a conventional binder in water. As the binder, there can be used any conventional binder such as a latex of a styrene-butadiene copolymer, a styrene-butadiene-acrylic ester copolymer, an acrylic ester-vinyl acetate copolymer, an acrylic ester-styrene copolymer, an acrylic ester-butadiene copolymer, etc., or other conventional water-soluble binders, for example, as the water-soluble binder there can be used water-soluble natural high molecular weight compounds such as proteins (e.g., gelatin, albumin, casein, etc.), cellulose derivatives (e.g., carboxymethyl cellulose, hydroxyethyl cellulose, etc.) and sucrose (e.g., agar-agar, sodium alginate, carboxymethyl starch, gum arabic, etc.); and water-soluble synthetic high molecular weight compounds such as polyvinyl alcohol, polyvinyl pyrrolidone, polyacrylic acid, polyacrylamide, mixtures thereof, etc.

The binder is preferably used in an amount of not more than 40 parts by weight per 100 parts by weight of color developer, and the total amount thereof is most preferably not more than 20 parts by weight. If the total amount exceeds 40 parts by weight, the color-developing ability is reduced and production cost would become undesirably high.

While the molecular weight of the binders is not particularly limited, most preferred results are obtained when binders having a molecular weight of from about 300 to about 1,000,000 are used.

To the coating solution there may be added, if desired, a resin powder, talc, zinc oxide or a like inorganic pigment in order to improve the surface properties thereof, such as smoothness, lubricity, and the like.

Coating can be effected in a conventional manner, e.g., using an air knife coater, a roll coater, a blade coater, a size press coater or the like.

The amount of the color former coated varies depending upon the kind of the color developer and, when clays are used as the color developer, the coating solution is preferably coated in an amount of not less than about 2 g/m$^2$, most preferably 3 – 8 g/m$^2$ based on the clay amount. When a phenol resin, metal salt of an aromatic carboxylic acid or the like is used as the color developer, the coating solution is preferably coated in an amount of not less than 0.5 g/m$^2$, most preferably 0.8 – 3 g/m$^2$, (calculated in terms of the color developer weight). When the amount coated is less than the lower limit, sufficient color developing ability cannot be obtained, whereas the upper limit is set from the economical viewpoint rather than the viewpoint of operability.

The effects of the desensitization printing process of the present invention were confirmed using the following color developer sheet, where all "parts" are weight.

Color developer sheet A 200 parts of sulfuric acid-activated clay (ca. 6 – 8 $\mu$) was dispersed in 800 parts of water, and the pH of the resulting dispersion was adjusted to 10.0 with a 20% sodium hydroxide aqueous solution. To this system were added a styrene-butadiene copolymer (m.w.=ca. 20,000) latex containing 60 mol % styrene in an amount of 40 parts (as solids) and 60 parts of a 10% aqueous starch solution to prepare a coating solution of the present invention. This coating solution was coated on a 50 g/m$^2$ paper in an amount of 6 g/m$^2$ (as solids) using a coating rod, followed by drying.

Color developer sheet B 5 parts of conventional acid clay and 1 part of aluminum oxide (approx. 3 – 6 $\mu$) were added to 20 parts of water and, while stirring, the pH of the resulting dispersion was adjusted to 10.5 with a 20% aqueous sodium hydroxide solution. Then, 6 parts of a 10% aqueous gelatin solution was added thereto and, further, a solution prepared by dissolving 0.56 part of zinc chloride in 8 parts of water was gradually added thereto.

A solution prepared by dissolving 2 parts of 3,5-di-tert-butylsalicylic acid in 20 parts of a 15% sodium hydroxide aqueous solution at 80° C was then gradually added thereto to react the same. To the resulting dispersion there was added 3 parts (as solids) of a latex of a styrene-methyl methacrylate copolymer (m.w. approx. 40,000) containing 50 mol % styrene to prepare a coating solution which was coated on a 50 g/m$^2$ paper in an amount of 4 g/m$^2$ (as solids) using a coating rod and dried.

Color developer sheet C 170 parts of p-phenylphenol and 70 parts of an aqueous 37% formaldehyde solution were refluxed for 10 hours while heating at 100° – 140° C in the presence of 10 parts of hydrochloric acid (37%) and 50 parts of water to react the same. After cooling, the phenol resin was recovered as a powder.

40 parts of the phenol resin obtained in the above-described manner and 6 parts of naphthalenesulfonic acid-formaldehyde condensate (approx. 1:1 molar) were ball milled for 1 day with 54 parts of water. Then, 100 parts of the phenol resin dispersion, 160 parts of kaolin (ca. 3 – 5$\mu$) and, as a binder, 40 parts (as solids) of a latex of a methyl methacrylate-butadiene copolymer (m.w. approx. 18,000) containing 50 mol % butadiene were added to 500 parts of water and mixed well to obtain a coating solution of the present invention.

This coating solution was coated on a 50 g/m² paper in an amount of 5 g/m² (as solids) using a coating rod and then dried.

The color former to be reacted with the color developer is not particularly limited, and specific examples thereof are as follows: 3,3-bis(p-dimethylaminophenyl)-6-dimethylaminophthalide, i.e., Crystal Violet Lactone, 3,3-bis(p-dimethylaminophenyl)phthalide, 3-(p-dimethylaminophenyl)-3-(1,2-dimethylindol-3-yl)phthalide, 3-(p-dimethylaminophenyl)-3-(2-methylindol-3-yl)phthalide, 3-(p-dimethylaminophenyl)-3-(2-phenylindol-3-yl)phthalide, 3,3-bis(1,2-dimethylindol-3-yl)-5-dimethylaminophthalide, 3,3-bis(1,2-dimethylindol-3-yl)-6-dimethylaminophthalide, 3,3-bis-(9-ethylcarbazol-3-yl)-5-dimethylaminophthalide, 3,3-bis-(2phenylindol-3-yl)-5-dimethylaminophthalide, 3-p-dimethylphenyl-3-(1-methylpyrrol-2-yl)-6-dimethylaminophthalide, (as triarylmethane compounds); 4,4'-bis-dimethylaminobenzhydrin benzyl ether, N-halophenylleucoauramine, N-2,4,5-trichlorophenylleucoauramine, etc. (as diphenylmethane compounds); rhodamine B-anilinolactam, rhodamine B-p-nitroanilinolactam, rhodamine B-p-chloroanilinolactam, 7-dimethylamino-2-methoxyfluoran, 7-diethylamino-2-methoxyfluoran, 7-diethylamino-3-methoxyfluoran, 7-diethylamino-3-chlorofluoran, 7-diethylamino-3-chloro-2-methoxyfluoran, 7-diethylamino-2,2-dimethylfluoran, 7-diethylamino-3-acetylmethylaminofluoran, 7-diethylamino-3'-methylaminofluoran, 3,7-diethylaminofluoran, 7-diethylamino-3-dibenzylaminofluoran, 7-diethylamino-3-methylbenzylamino-fluoran, 7-diethylamino-3-phenylamino-2-methylfluoran, 7-diethylamino-3-chloroethylmethylaminofluoran, 7-diethylamino-3-diethylaminofluoran, etc. (as xanthene compounds), benzoyl leucomethylene blue, p-nitrobenzyl leucomethylene blue, etc. (as thiazine compounds); 3-methyl-spiro-dinaphthopyran, 3-ethyl-spiro-dinaphthopyran, 3,3'-dichlorospiro-dinaphthopyran, 3-benzylspiro-dinaphthopyran, 3-methyl-naphtho-(3-methoxybenzo)-spiropyran, 3-propyl-spiro-dibenzopyran, etc. (as spiro compounds); and mixtures thereof.

The color former is coated on a support by dissolving the same in a solvent and encapsulating the resulting solution, or by dispersing in the same a binder solution.

As the solvent, natural or synthetic oils can be used alone or as combinations thereof. As examples of the solvent, there can be illustrated cotton seed oil, kerosene, paraffin, naphthene oil, alkylated biphenyls, alkylated terphenyls, chlorinated paraffins, alkylated naphthalenes and the like. As processes for forming capsules, there can be used any conventional coacervation process for hydrophilic colloid sols, e.g., as described in U.S. Pat. Nos. 2,800,457 and 2,800,458, conventional interfacial polymerization processes as described in British Pat. Nos. 867,797, 950,443, 989,264, 1,091,076, etc., and the like.

The effects of the desensitization printing process of the present invention were confirmed using the following color former sheets.

Preparation of color former sheet A 10 parts of acid-processed gelatin having an isoelectric point of 8.0 and 10 parts of gum arabic were dissolved in 60 parts of 40° C water, and 0.2 g of sodium dodecyl benzenesulfonate added thereto as an emulsifying agent. Then, 50 parts of a color former-containing oil was emulsified therein.

The color former-containing oil was prepared by dissolving 2.5% by weight of Crystal Violet Lactone and 2.0% by weight of benzoyl leucomethylene blue in an oil consisting of 4 parts of diisopropylbiphenyl and 1 part of kerosene.

When the average size of the emulsified oil droplets reached 8 μ, emulsification was discontinued by adding 100 parts of 40° C water thereto.

Continuing the stirring, 210 parts of 30° C water was added thereto, and 20% hydrochloric acid was added to adjust the pH of the system to 4.4. While further continuing stirring, the system was cooled to 8° C, followed by adding thereto 1.5 parts of 20% glutaraldehyde.

Subsequently, 30 parts of a 10% aqueous carboxymethyl starch solution was added thereto and, after adjusting the pH to 8.5 by dropwise adding 25% sodium hydroxide, the system was heated to 30° C to obtain microcapsules having a hard shell.

10 parts of cellulose floc was dispersed into this mixture, and the resulting coating solution coated on a 40 g/m² paper in an amount of 6 g/m² (as solids) and dried to obtain color former sheet A.

Preparation of color former sheet B

A color former-containing oil was prepared by dissolving 1% by weight of Crystal Violet Lactone, 4% by weight of 3-diethylamino-7-diethylaminofluoran, 4% by weight of 3-diethylamino-7-phenylaminofluoran, 3% by weight of 3-diethylamino-7,8-benzofluoran, 0.5% by weight of 3,6-bismethoxy-fluoran and 2% by weight of benzoyl leucomethylene blue in an oil consisting of 1 part of diisopropylnaphthalene, 1 part of diisopropylbiphenyl and 2 parts of 1-(dimethylphenyl)-1-phenylethane. Color former sheet B was prepared in the same manner as for color former sheet A using 50 parts of the above color former-containing oil.

EXAMPLE 1

An aluminum plate was immersed for 1 minute in a 10% by weight aqueous sodium tertiary phosphate solution (solution temperature: 70° C) to degrees the surface of the aluminum plate. At this stage, gray impurities adhered to the surface of the aluminum plate, which could not be removed by washing with water. The plate was then immersed for 1 minute in 70% nitric acid at room temperature (23° C) to expose a pure aluminum surface. The aluminum plate having a pure aluminum surface was immersed in 20% sulfuric acid (20° C), and subjected to anodic oxidation for 5 minutes under the conditions: 12 V direct current voltage; 2 A/dm² current density. After washing with water, the aluminum plate was immersed for 3 minutes in 20% phosphoric acid at 50° C. After washing with water and drying, the following solution was coated onto the aluminum plate, which was then dried at 100° C for 2 minutes to a 2 μ dry thickness.

| | | |
|---|---|---|
| Polyvinyl alcohol (GL-05, made by Nippon Synthetic Chemical Industry Co., Ltd.; m.w. approx. 2,500) | 0.1 | g |
| Methanol | 50 | ml |
| Water | 50 | ml |

A solution consisting of 2 g of light-sensitive polycarbonate resin as disclosed in Canadian Patent 696,997 [ternary condensation polymer of 4,4'-isopropylidenebisphenol (bisphenol A), divanillal cyclopentanone and neopentyl bischloroformate; viscosity [η]: 0.13], 0.1 g of 5-nitroacenaphthene, 50 g of monochlorobenzene and 50 g of ethylene chloride was then coated therein using a whirler and dried to a dry thickness of 20 μ.

The thus prepared printing plate was exposed for 2 minutes in a pneumatic printing frame through a transparent negative film (only areas where desensitization was not desired being transparent) using a 35 A carbon arc lamp spaced at a distance of 70 cm therefrom.

The thus exposed printing plate was immersed for 1 minute in a trough filled with dimethylsulfoxide and slowly shaken at 23° C. After washing with water and drying, there was obtained a plate for lithographic printing. This plate had high oleophilicity due to the light-sensitive resin layer where areas, where desensitization was not desired, were hardened. At the hardened areas, a desensitizer, polyoxyethylene trimethylenediamine (molecular weight: 1,300), showed a contact angle of 32°. In all instances, the contact angle was determined in a conventional manner using a Goniometer Type G-1 (Erman Kogaku Co., Ltd.).

This plate was then loaded on a lithographic press and a 50% polyoxyethylene trimethylenediamine (molecular weight: 1,300) solution was supplied to the plate by means of the damping water-feeding device of the press to conduct desensitization printing on color developer sheets A, B and C.

EXAMPLE 2

Desensitization printing was conducted in the same manner as in Example 1 except for using polyethylene glycol (molecular weight: 400) in place of polyoxyethylene trimethylenediamine. The polythylene glycol used showed a contact angle of 30° at the areas of the plate where desensitization was not desired (oleophilic areas).

Comparative Example 1

Desensitization printing was conducted in the same amnner as in Example 1 except for using polyoxyethylene stearyl-amine (molecular weight: 800) in place of polyoxyethylene trimethylenediamine.

The polyoxyethylene stearylamine used (molecular weight: 800) showed a contact angle of 14° at the areas of the plate where desensitization was not desired.

EXAMPLE 3

A 3S18H aluminum plate was subjected to sand-blasting of both surfaces using 250 mesh Alundum, and was then immersed for 1 minute in a 20% aqueous sodium tertiary phosphate solution heated to 70° C. After washing with water, the plate was immersed for 1 minute in 70% nitric acid at 23° C, followed by washing with water. The plate was then immersed for 2 minutes in a 2% aqueous solution of sodium silicate heated to 80° C to form a hydrophilic layer on the surface of the aluminum plate.

After washing with water and drying, a coating solution, (prepared by dissolving 5 parts by weight of a diazoxide type light-sensitive material synthesized according to the process described in Example 1 of Japanese Patent Publication 28,403/68 and 10 parts by weight of an oil-soluble phenol resin (Hitanol 1031, made by Hitachi Chemical Co., Ltd.; MP 126° - 145° C, alkyl phenol-formaldehyde condensate) in a solvent of 100 parts by weight of methyl ketone and 80 parts by weight of cyclohexanone) was coated on the hydrophilic layer formed on the aluminum plate using a whirler to a dry thickness of 20 μ, followed by drying. This plate was exposed for 2 minutes through a positive film (areas where desensitization was desired being transparent) using a 35 A arc lamp spaced at a distance of 70 cm therefrom. The plate was then immersed for 1 minute in a 5% aqueous sodium tertiary phosphate solution to dissolve away exposed areas, followed by drying. Unexposed areas of the plate showed high oleophilicity, and a desensitizer, 3,9-bis(aminomethyl)-2,4,8,10-tetraoxaspiro[5,5]undecane, showed a contact angle therewith of 31°.

This plate was then loaded on a lithographic press, and desensitization printing conducted on color developer sheets A, B and C by supplying a mixture of 3,9-bis(aminomethyl)-2,4,8,10-tetraoxaspiro[5,5]undecane and glycerin (at equivalent weights) by means of an ink-feeding device.

EXAMPLE 4

Desensitization printing was conducted in the same manner as in Example 3 except for using 1,8-diaza-bicyclo(5,4,0) undecane-7 in place of 3,9-bis(aminomethyl)-2,4,8,10-tetraoxaspiro[5,5]undecane.

The contact angle of the 1,8-diaza-bicyclo(5,4,0)-undecane-7 in oleophilic areas of the plate was 24°.

EXAMPLE 5

Desensitization printing was conducted in the same manner as in Example 3 except for using polyoxyethylene ethylene-diamine (molecular weight: 1,000) in place of 3,9-bis(aminomethyl)-2,4,8,10-tetraoxaspiro[5,5]-undecane.

The contact angle of the polyoxyethylene ethylene-diamine (molecular weight: 1,000) in oleophilic areas of the plate was 35°.

Comparative Example 2

Desensitization printing was conducted in the same manner as in Example 3 except for using polypropylene glycol (molecular weight: 1,000) in place of 3,9-bis-(aminomethyl)-2,4,8,10-tetraoxaspiro[5,5]-undecane.

The contact angle of the polypropylene glycol (molecular weight: 1,000) at oleophilic areas of the plate was 11°.

Testing Method

The color developer sheets subjected to desensitization printing in the foregoing Examples and Comparative Examples were tested as follows to estimate the effects of the present invention.

(i) Plate Accuracy

A 1% toluol solution of a color former (Crystal Violet Lactone) was blown against the plate to test whether desensitizer was coated on the areas where desensitization was not desired.

When desensitizer was coated on the areas where desensitization was not desired, coloration did not occur even when the color former solution was blown against the plate.

(ii) The desensitization areas were placed face-to-face with the color former sheet, and a pressure of 600 kg/cm$^2$ was applied to form color, whereafter reflection visual density (Vis. D) after standing for one day and one night at normal conditions was measured to estimate the desensitizing effect.

Table 1

| | | Desensitizing Effect (Vis. D) | | | |
|---|---|---|---|---|---|
| | | Color Former Sheet A | | | Color Former Sheet B |
| | Plate Accuracy | Color Developer Sheet A | Color Developer Sheet B | Color Developer Sheet C | Color Developer Sheet A |
| Ex. 1 | Excellent | 0.05 | 0.05 | 0.05 | 0.07 |
| Ex. 2 | Excellent | 0.06 | 0.06 | 0.05 | 0.07 |
| Comp. Ex. 1 | Poor | 0.05 | 0.06 | 0.05 | 0.07 |
| Ex. 3 | Excellent | 0.05 | 0.05 | 0.05 | 0.06 |
| Ex. 4 | Good | 0.05 | 0.05 | 0.05 | 0.05 |
| Ex. 5 | Excellent | 0.05 | 0.06 | 0.05 | 0.07 |
| Comp. Ex. 2 | Poor | 0.06 | 0.06 | 0.05 | 0.08 |

The value of the desensitization printing process of the present invention is clear from the above Table, i.e., with desensitizers showing a contact angle of not less than 15° at oleophilic non-image areas of the plate, the printed images sufficiently reproduced the plate image.

In particular, with desensitizers showing a contact angle of not less than 25°, adhesion or accumulation of desensitizer at the oleophilic areas was not observed at all.

Further, the numerical values in the Table show the desensitizing effect, where values of less than 0.08 show that desensitization was almost complete. Thus, it is seen that an extremely high desensitizing effect can be obtained by the process of the present invention with respect to the all color developers and all kinds of the color formers.

Desensitization printing by lithographic printing process, which has so far been impossible, can be effected in an extremely effective manner.

While the invention has been described in detail and with reference to specific embodiments thereof, it will be apparent to one skilled in the art that various changes and modifications can be made therein without departing from the spirit and scope thereof.

What is claimed is:

1. A process for producing a locally desensitized color developer sheet which comprises printing a desensitizor or desensitizor composition for color developer on a color developer sheet using a lithographic printing plate having hydrophilic image areas and hydrophobic non-image areas, wherein said desensitizor composition consists essentially of a desensitizor and water or consists essentially of a desensitizor and an organic solvent having a dielectric constant (at 20° C) of not less than about 5.0 and a surface tension (at 20° C) of not less than about 15 dyne/cm, said desensitizor composition being hydrophilic in nature so as to wet said hydrophilic image and be repelled by said hydrophobic non-image areas said densitizor being selected from polyethylene glycol, polyalkylene polyamines represented by the following general formula:

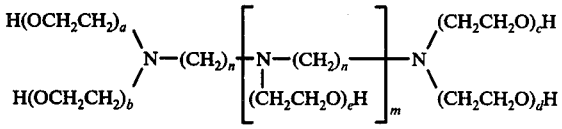

wherein $n$ represents an integer of 2 - 5, $m$ represents an integer of 0 - 6, $a$, $b$, $c$, $d$ and $e$ each represents an integer other than 0 and $a + b + c + d + e$ are about 5 - 200;

amine derivatives represented by the following general formula:

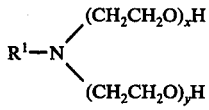

wherein $R^1$ represents a $C_2$–$C_{10}$ alkyl group, an aryl group, preferably with up to 18 carbon atoms, an aralkyl group, preferably of from 7 to 18 carbon atoms, or $(CH_2CH_2O)_zH$, $x + y$ being about 3 - 100 and $x + y + z$ are about 5 - 100;

spiroacetal diamines represented by the following general formula:

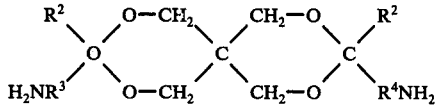

wherein $R^2$ represents a hydrogen atom or an alkyl group, and $R^3$ and $R^4$ each represents a $C_1$–$C_6$ straight or branched chain alkylene group;

reaction products between the above-described spiroacetal diamine and a compound containing in its molecule one or more oxirane groups;

diazabicycloalkenes represented by the following general formula:

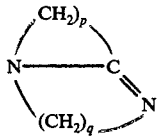

wherein $q$ represents 2 - 6, and $p$ represents 2 - 11; and compounds between the above described diazabicycloalkene and water or an acid.

2. The process of claim 1 wherein the desensitizer or desensitizer composition for color developer is coated in an amount of from about 0.5 to about 8.0 g/m² of the color developer layer, based on desensitizer weight.

3. The process of claim 1, consisting of applying said desensitizor or desensitizor composition to said lithographic printing plate and thereafter lithographically printing on said color developer sheet, whereby said desensitizor or desensitizor composition is applied to areas of said color developer on said color developer sheet which correspond to the hydrophilic image areas of said lithographic printing plate.

* * * * *